United States Patent [19]

Oya et al.

[11] 4,110,976

[45] Sep. 5, 1978

[54] THERMAL REACTOR SYSTEM

[75] Inventors: Hiroo Oya; Masakazu Tatejima, both of Ohta, Japan

[73] Assignee: Fuji Heavy Industries Limited, Tokyo, Japan

[21] Appl. No.: 729,684

[22] Filed: Oct. 5, 1976

[30] Foreign Application Priority Data

Oct. 7, 1975 [JP] Japan ..... 50-136781[U]

[51] Int. Cl.[2] ..... F01N 3/10; F01N 7/10

[52] U.S. Cl. ..... 60/282; 60/323

[58] Field of Search ..... 60/282, 323

[56] References Cited

U.S. PATENT DOCUMENTS 3,990,233 11/1976 Will ..... 60/282

3,990,856 11/1976 Suzuki ..... 60/282

*Primary Examiner*—Douglas Hart

*Attorney, Agent, or Firm*—Martin A. Farber

[57] ABSTRACT

A thermal reactor system for oxidizing unburned hydrocarbons and carbon monoxide emitted from internal combustion engines, which comprises a thermal reaction chamber of convex shape defined by an inner wall of an inner shell, the latter being spaced from an outer shell forming an exhaust passage between the shells. The reaction chamber communicates with an exhaust pipe connected to the exhaust port of the engine. The exhaust pipe is inserted into the reaction chamber through an outlet opening of the reaction chamber. The end opening of the exhaust pipe and the outlet opening of the reaction chamber are disposed such that the exhaust gases emitted from the end opening of the exhaust pipe swirls in the reaction chamber and exhausts through the outlet opening after swirling and enters the exhaust passage communicating therewith.

5 Claims, 2 Drawing Figures

THERMAL REACTOR SYSTEM

Figure 1:
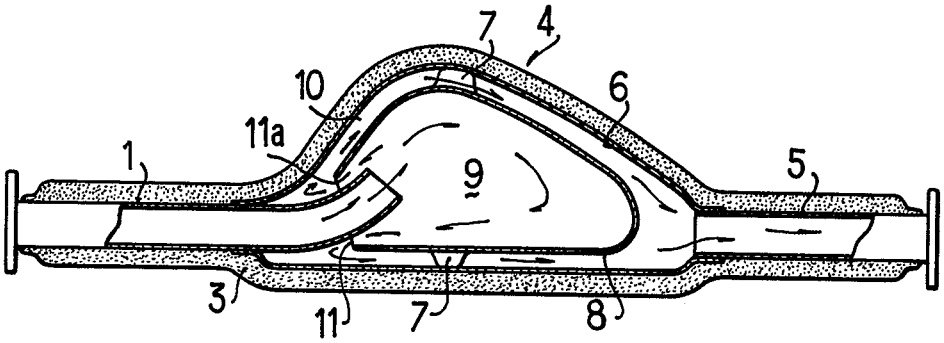

The present invention relates to a thermal reactor system for internal combustion engines and more particularly to a thermal reactor provided in the exhaust passage to reduce the unburned hydrocarbons and carbon monoxide emitted from internal combustion engines.

In order to promote the reaction of the unburned constituents in the thermal reactor, it is effective to increase the capacity of the reactor to elongate the residence time of the exhaust gases. However, it is disadvantageous to provide a large thermal reactor in the exhaust system of the engine, especially for automobiles.

Therefore, it is an object of the present invention to provide a thermal reactor system in which a reaction chamber has a relatively small capacity and provides a long residence time of the exhaust gases.

A further object of the present invention is to provide a thermal reactor system in which the unburned hydrocarbons and carbon monoxide can be substantially incinerated to innocuous products.

A further object of the present invention is to provide a thermal reactor system which is simplified in construction.

In accordance with the present invention, the system is provided with a thermal reactor having a reaction chamber. The exhaust pipe communicated with the exhaust ports of the engine is inserted into the reaction chamber passing through an outlet opening of the chamber, whereby exhaust gases emitted from the exhaust pipe flow in the reaction chamber in the form of swirl and flow out through the outlet opening after swirling. Thus, the residence time of the exhaust gases in the reaction chamber maybe extended, which causes the promotion of oxidation of unburned hydrocarbons and carbon monoxide.

Further, in accordance with the present invention, the exhaust pipe is extended a considerable long length in the reaction chamber, so that the end portion of the exhaust pipe is heated to a high temperature or red hot, whereby the unburned constituents may be incinerated in flames.

Figure 2:
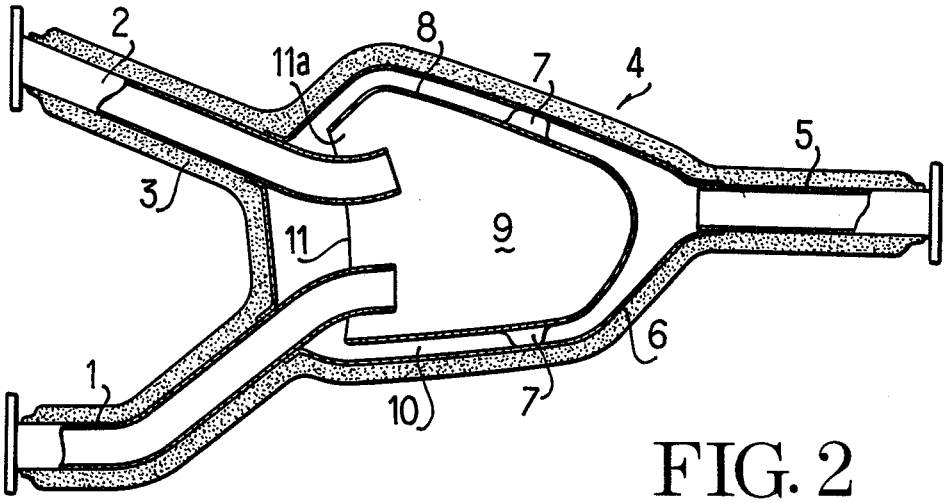

The present invention will be further elucidated with reference to the drawing showing one embodiment, wherein:

FIG. 1 is a sectional side view of a thermal reactor according to the present invention, and FIG. 2 is a sectional plan view of the thermal reactor.

Referring to the drawing, there is shown a thermal reactor system for the four-cylinder engine. Each of exhaust pipes 1 and 2 is connected to a manifold which is communicated with each exhaust port of two cylinders. Both exhaust pipes 1 and 2 are coated with an insulating material 3 and communicated with a thermal reactor 4 of the present invention which is further communicated with an exhaust pipe 5 which in turn connected to a muffler (not shown). The thermal reactor 4 comprises an outer shell 6 covered by the insulating material 3 and an inner shell 8 which is supported in the outer shell by projections 7 to form an exhaust passage 10. The inner shell 8 is formed with a reaction chamber 9 having an outlet opening 11. The central upper part of the inner shell 8 is elevated to form a conical chamber.

Each of the exhaust pipes 1 and 2 is inserted into the reaction chamber 9 passing through the outlet opening 11 and extended a considerable long length into the chamber.

Each exhaust pipe is spaced from the periphery of the outlet opening 11 to form an outlet of the reaction chamber 9 for the exhaust gases. The end portion of each exhaust pipe is bent to be parallel the inner wall of the reaction chamber, so that exhaust gases from the end openings of the exhaust pipes may flow along the inner wall in the form of swirl. It will be noted that the outlet opening 11 of the reaction chamber is located at the end of the swirl of the exhaust gases. The outlet opening 11 is communicated with the exhaust passage 10 which is further communicated with the exhaust pipe 5.

The exhaust gas flow emitted from the end opening of the exhaust pipe 1 or 2 swirl along the inner wall of the reaction chamber 9 as shown by arrows, so that the exhaust gases reside for a relatively long term in the reaction chamber. Thus, the exhaust gases are mixed in the chamber which promotes an oxidation of the unburned constituents. The oxidized gases heat the extended end portions of the exhaust pipes 1 and 2 to a high temperature or to a red heat state. Therefore, the unburned gases emitted from the end opening of the exhaust pipe are incinerated in flames. Thus, effective oxidation of the unburned constituents may be carried out. The combustion gases flow through the narrow outlet passage 11*a* between the exhaust pipes 1 and 2 and the inner wall of the reaction chamber, where the gases heat the end portions of the exhaust pipes to maintain them at a high temperature, and thereafter the gases turn after the outlet opening 11 and flow into the exhaust passage 10. The gases passing through the exhaust passage 10 act as a heat insulation and then flow into the exhaust pipe 5.

The present system has been shown to be highly efficient in oxidation of the unburned hydrocarbons and carbon monoxide. This makes it possible to provide a small and simple reactor system which is advantageous for use on automotive vehicles.

What is claimed is:

1. A thermal reactor system for an internal combustion engine comprising a first exhaust pipe communicating with exhaust ports of the engine and having an opening, a thermal reactor communicating with said first exhaust pipe, a second exhaust pipe operatively communicating with said thermal reactor, said thermal reactor comprising, an outer shell covered by an insulating material, an inner shell having substantially the same shape as but smaller than that of said outer shell and being disposed in said outer shell spaced therefrom defining an exhaust passage therebetween, projections between said inner and outer shells supporting said inner shell spaced from said outer shell and defining said exhaust between said outer shell and said inner shell, said inner shell defining a reaction chamber of substantially convex shape including an inlet-outlet section, and an intermediate section having a progressively narrowing substantially conical shape, and an innermost end section having a substantially convex shape, respectively, said inlet-outlet section of said inner shell being formed with an outlet opening of said reaction chamber spaced opposite from said innermost end section and communicating with said exhaust passage, said first exhaust pipe being inserted into said reaction chamber passing through said outlet opening defining an outlet thereof therearound, said second exhaust pipe communicating with said exhaust passage at a position on the opposite side of said innermost end section from said inlet-outlet section, and said first exhaust pipe having an end portion adjacent said opening thereof and being oriented substantially parallel to an adjacent portion of said inlet-outlet section of said inner shell of said reaction chamber, whereby for each portion of exhaust gas a single swirl of exhaust gases is produced in said reaction chamber starting from an opening of said first exhaust pipe and ending completely feeding into said outlet of said reaction chamber

2. A thermal reactor system for internal combustion engines according to claim 1 in which said first exhaust pipe is extended a long length in the reaction chamber.

3. The thermal reactor system for an internal combustion engine as set forth in claim 1, wherein said inlet-outlet section diverges in a direction from said outlet opening to said intermediate section.

4. A thermal reactor system for an internal combustion engine comprising a pair of first exhaust pipes communicating with exhaust ports of the engine and each of said pipes having an opening, a thermal reactor communicating with said first exhaust pipes, a second exhaust pipe operatively communicating with said thermal reactor, said thermal reactor comprising, an outer shell covered by an insulating material, an inner shell having substantially the same shape as but smaller than that of said outer shell and being disposed in said outer shell spaced therefrom defining an exhaust passage therebetween, projections between said inner and outer shells supporting said inner shell spaced from said outer shell and defining an exhaust passage between said outer shell and said inner shell, said inner shell defining a reaction chamber of substantially convex shape including an inlet-outlet section, and an intermediate section having a progressively narrowing substantially conical shape, and an innermost end section having a substantially convex shape, respectively, said inlet-outlet section of said inner shell being formed with an outlet opening of said reaction chamber spaced opposite from said innermost end section and communicating with said exhaust passage, said first exhaust pipes being inserted into said reaction chamber passing through said outlet opening defining an outlet thereof therearound, said second exhaust pipe communicating with said exhaust passage at a position on the opposite side of said innermost end section from said inlet-outlet section, and said first exhaust pipes each having an end portion adjacent said opening thereof being oriented substantially parallel to an adjacent portion of said inlet-outlet section of said inner shell of said reaction chamber, whereby for each portion of said exhaust gases, a single swirl of exhaust gases is produced in said reaction chamber starting from each of said opening of said first exhaust pipes, respectively, and ending completely feeding into said outlet of said reaction chamber

5. The thermal reactor system for an internal combustion engine as set forth in claim 4, wherein said inlet-outlet section diverges in a direction from said outlet opening to said intermediate section.

* * * * *